US008349133B2

(12) United States Patent
Duarte Villa et al.

(10) Patent No.: US 8,349,133 B2
(45) Date of Patent: Jan. 8, 2013

(54) PAPER BASED ON RECYCLED PAPERS AND PROCESS FOR PRODUCING THEREOF

(75) Inventors: Eduardo Duarte Villa, Nuevo Leon (MX); José Trinidad Peregrina Gomez, Nuevo Leon (MX)

(73) Assignee: Copamex, S.A. de C.V, Nuevo Leon (MX)

( * ) Notice: Subject to any disclaimer, the term of this patent is extended or adjusted under 35 U.S.C. 154(b) by 0 days.

(21) Appl. No.: 13/444,540

(22) Filed: Apr. 11, 2012

(65) Prior Publication Data

US 2012/0205064 A1 Aug. 16, 2012

Related U.S. Application Data

(62) Division of application No. 12/631,519, filed on Dec. 4, 2009, now Pat. No. 8,157,958.

(30) Foreign Application Priority Data

Dec. 19, 2008 (MX) ..... MX/a/2008/016581

(51) Int. Cl.
*D21F 11/00* (2006.01)

(52) U.S. Cl. ..... 162/146

(58) Field of Classification Search ..... 162/146, 162/158, 177, 175, 179, 181.8, 181.2, 181.5
See application file for complete search history.

(56) References Cited

U.S. PATENT DOCUMENTS

| | | | |
|---|---|---|---|
| 5,228,692 | A | 7/1993 | Carrick et al. |
| 6,207,258 | B1 | 3/2001 | Varnell |
| 2005/0217815 | A1 | 10/2005 | Stoffel et al. |
| 2006/0042767 | A1 | 3/2006 | Bhat et al. |
| 2007/0087136 | A1 | 4/2007 | Stoffel et al. |
| 2007/0087138 | A1 | 4/2007 | Koenig et al. |

*Primary Examiner* — Mark Halpern

(74) *Attorney, Agent, or Firm* — Parsons & Goltry; Michael W. Goltry; Robert A. Parsons

(57) ABSTRACT

A paper includes a composition of 10% by weight to 40% by weight of recovered post-consumer paper, 60% by weight to 90% by weight of recovered white paper, 0.38% by weight to 0.45% by weight of one or more sizing agents, and 3.33% by weight to 3.95% by weight of one or more binding agents.

15 Claims, 4 Drawing Sheets

PAPER BASED ON RECYCLED PAPERS AND PROCESS FOR PRODUCING THEREOF

TECHNICAL FIELD OF THE INVENTION

The present invention relates to processes for manufacturing paper and products manufactured by these processes. More particularly, the invention relates to a composition and a process for obtaining a recycled paper from a recycled paper pulp mixture composed by recovered post-consumer paper type of kraft paper and recovered white paper.

BACKGROUND OF THE INVENTION

At present, the growing interest for the environment contributes to a significant increase of the recycling or recovering of paper. On the other hand, this means that more and more recovered paper is recycled into new paper. Numerous technical developments aim to expand the areas of use for recovered paper.

The kind of purity that is required for certain paper products can be accomplished whether at the time of the reception of the recovered paper as in the case of shops, companies and industries. On the other hand, the necessary characteristics must be achieved for production by selecting and organizing the paper. This applies to the majority of recovered paper coming from private sources. In this sector more than half of the collected material is sorted and recycled separating the packaging from the rest of the recovered paper. The remaining part of the packaging is recycled together with other recovered paper, mixing them.

The dark varieties of waste paper can be used exclusively for the manufacture of packaging paper and cardboard. On the contrary, manufacturers of graphic papers (e.g. newsprint) and hygiene paper (e.g. toilet paper) require clear varieties of paper.

Traditionally, the reuse of waste paper from packaging paper and cardboard clearly occupies the first place.

However, there are also limits to the use of recovered paper. Each step of recycling involves wear, that is, an alteration of the physical characteristics due to a loss of consistency and therefore a diminished quality of the fiber material.

The fiber is shortened and can not be put together properly as required for the formation of sheets. Therefore, a part of fresh fibers is always required. In the process of recycling, fibers can be used an average of 6 times, until they have to be eliminated from the production process as a rejection along with impurities and remains of impurities.

Some technical characteristics of recycled paper are comparable to those of paper made from virgin fiber in terms of consistency, production, surface and duration, though the optical characteristics such as whiteness and purity are of a lower quality. The printing result may have limitations as to the quality.

The processing systems of waste paper have a preset station where thicker impurities are removed such as: staples, pieces of glass and wood, etc. After the waste paper material is submitted to a cleaning to prevent the finest impurities such as sand and plastic parts to enter the process. As a next step, all systems crush (dissolve) the paper used with recirculated water. Additionally, the clear varieties of waste paper, which apply to the production of graphic papers and hygiene papers, undergo a process that serves to eliminate traces of ink on paper. This mechanical chemical cleaning is carried out with chemicals like soap or caustic soda to dissolve the printing inks.

According to the above, it is therefore necessary to provide a paper made from recovered paper that has technical characteristics and a similar or superior appearance compared with the characteristics of paper made from virgin pulp fiber.

SUMMARY OF THE INVENTION

According to the above and in order to offer a solution for the constraints encountered, the object of the invention is to provide a paper consisting of 10% to 40% by weight of recovered post-consumer paper, of 60% to 90% by weight of recovered white paper; of 0.38% to 0.45% by weight of one or more sizing agents, and of 3.33% to 3.95% by weight of one or more binding agents.

Another object of the invention is to provide a process for producing paper that comprises the steps of forming a paper pulp from a mixture of 10% to 40% by weight of recovered post-consumer paper, of 60% to 90% by weight of recovered white paper, and 0.38% to 0.45% by weight of one or more binding agents; reacting the pulp mixture with 0.38% to 0.45% of one or more of the sizing agents, and 0.75% to 0.9% by weight of one or more binding agents; forming and drying a continuous sheet of paper from pulp; and reacting the continuous sheet of paper with 2.2% to 2.6% by weight of one or more binding agents.

BRIEF DESCRIPTION OF THE FIGURES

The characteristic details of the present invention are described in the following paragraphs, together with the figures related to it, in order to define the invention, but not limiting the scope of it.

DETAILED DESCRIPTION OF THE INVENTION

Figure 1:
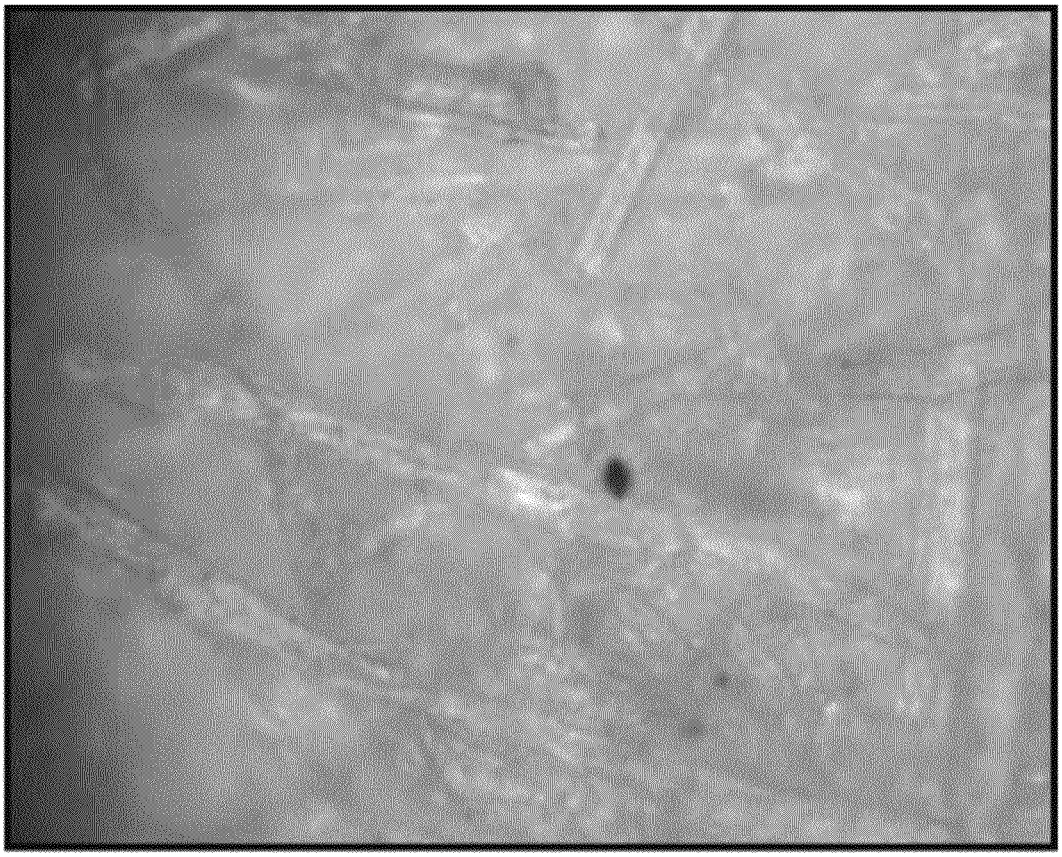
FIG. 1 illustrates a magnified view 200× of a portion of a frame of a first embodiment of a paper according to this invention.

The characteristic details of this invention are described in the following paragraphs, which have the objective of defining the invention, but without limiting its scope.

The composition of the paper according to the invention shows components that in turn may consist of multiple components. The components are described individually below, without necessarily being described in any order of importance.

Cellulose Fiber

The present invention includes a mixture of recovered post-consumer paper and recovered white paper recovered.

The term "recovered post-consumer paper" under the context of this description refers to paper or paper objects that have been used by the end-user and have then been returned to the factory for recycling. Some examples of recovered post-consumer paper that can be used in this invention are:

Cardboard: A sheet consisting mainly of cellulose with a higher mass (base weight) to 240 g/m$^2$.

Solid fibreboard: A sheet consisting of a set of sheets of paper or cardboard joined by compressed and by an adhesive.

Corrugated Containers (OCC): It is the structure consisting of one or more sheets of corrugated paper (Medium), adhered to one or more sheets of paper, kraft paper or flat board (liner). The following three main classes are distinguished:

Simple Corrugated Cardboard: A structure consisting of a sheet of corrugated paper, adhered between two sheets of paper, kraft paper or cardboard (liner).

Single-sided Corrugated Cardboard: A structure consisting of one sheet of corrugated paper, adhered on one sheet of paper, kraft paper or cardboard (liner).

Double Corrugated Cardboard: A structure consisting of two interleaved corrugated sheets of paper and adhered, or three sheets of paper, kraft paper or cardboard (liners).

Rolled Cardboard (water carton): Generic term for a uniform carton with a thickness usually greater than 1 mm, generally made from mixtures of waste paper on a rotating drum machine obtained intermittently.

Duplex, Triplex or Multiplex Cardboard: Carton commonly called cardboard, comprising two or more fibrous units by compression in the humid section of the manufacturing process.

Gray Cardboard: Carton made from secondary fibers, in which generally the quality specifications are only weight and caliber.

Solid Cardboard: Carton comprising a single layer of cellulosic material and formed by a flat machine.

Paper Board: A sheet mainly consisting of cellulose with a higher mass (base weight) between 160 $g/m^2$ and up to 240 $g/m^2$.

Kraft Paper: A paper made of pulp exclusively produced by a chemical cellulose prepared by the sulphate process (Kraft process), usually from wood and that has the characteristics of being highly resistant to mechanical stress.

Soft Mixed Paper (SMP): Consists of a clean, sorted mixture of various qualities of paper not limited as to type of fiber content.

Hard Mixed Paper (HMP): Consists of a clean, sorted mixture of various qualities of paper containing less than 10% groundwood content.

Boxboard Cuttings: Consists of new cuttings of paperboard used in the manufacture of folding cartons, set-up boxes and similar boxboard products.

Mill Wrappers: Consists of paper used as outside wrap for rolls, bundles, or skids of finished paper.

Groundwood paper: Consists of 10% to 75% of mechanically treated cellulose pulp.

News: Consists of newspaper as typically generated from news drives and curbside collections.

News De-ink Quality (#7 ONP): Consists of sorted, fresh newspapers, not sunburned, containing not more than the normal percentage of rotogravure and colored sections. May contain magazines.

Special News De-ink Quality (#8 ONP): Consists of sorted, fresh newspapers, not sunburned, free from magazines, white blank, pressroom over-issues, and paper other than news, containing not more than the normal percentage of rotogravure and colored sections. This grade must be tare-free.

Over-Issue News (OI or OIN): Consists of unused, overrun newspapers printed on newsprint, containing not more than the normal percentage of rotogravure and colored sections.

Magazines (OMG): Consists of coated magazines, catalogues, and similar printed materials. May contain a small percentage of uncoated newstype paper.

New Double-Lined Kraft Corrugated Cuttings (DLK): Consists of new corrugated cuttings having liners of either test liner, jute, or kraft. Treated medium or liners, insoluble adhesives, butt rolls, slabbed or hogged medium, are not acceptable in this grade.

Used Brown Kraft: Consists of brown kraft bags free of objectionable liners and original contents.

Mixed Kraft Cuttings: Consists of new brown kraft cuttings, sheets and bag scrap free of stitched paper.

New Colored Kraft: Consists of new colored kraft cuttings, sheets and bag scrap, free of stitched papers.

Grocery Bag Scrap (KGB): Consists of new brown kraft bag cuttings, sheets and misprint bags.

Kraft Multi-Wall Bag Scrap: Consists of new brown kraft multi-wall bag cuttings, sheets, and misprint bags, free of stitched paper.

New Brown Kraft Envelope Cuttings: Consists of new unprinted brown kraft envelopes, cuttings or sheets.

Mixed Groundwood Shavings: Consists of trim of magazines, catalogs and similar printed matter, not limited with respect to groundwood or coated stock, and may contain the bleed of cover and insert stock as well as beater-dyed paper and solid color printing.

Groundwood Computer Printout (GWCPO): Consists of groundwood papers which are used in forms manufactured for use in data processing machines. This grade may contain colored stripes and impact or nonimpact (e.g., laser) computer printing.

New Colored Envelope Cuttings: Consists of groundwood-free cuttings, shavings, or sheets of untreated, uncoated bleachable colored envelope paper Semi Bleached Cuttings: Consists of sheets and cuttings of unprinted, untreated, groundwood-free paper such as file folder stock, manila tabulating card trim, untreated milk carton stock, or manila tag.

Unsorted Office Paper (UOP): Consists of printed or unprinted paper typically generated in an office environment that may include a document destruction process. This grade may contain white, colored, coated and uncoated papers, manila and pastel colored file folders.

Sorted Office Paper (SOP): Consists of paper, as typically generated by offices, containing primarily white and colored groundwood-free paper, free of unbleached fiber. May include a small percentage of groundwood computer printout and facsimile paper.

Manifold Colored Ledger (MCL): Consists of sheets, shavings, and cuttings of industrially generated printed or unprinted colored or white ground wood free paper. All stock must be uncoated and free of nonimpact printing. A percentage of carbonless paper is allowable.

Coated Groundwood Sections (CGS): Consists of printed, coated groundwood paper in sheets, sections, shavings or guillotined books. This grade may not include news quality groundwood paper Printed Bleached Board Cuttings: Consists of groundwood-free printed bleached board cuttings, free from misprint sheets, cartons, wax, greaseproof lamination, gilt, and inks, adhesives or coatings that are insoluble.

Misprinted Bleached Board: Consists of groundwood-free misprint sheets and cartons of bleached board, free from wax, greaseproof lamination, gilt, and inks, adhesives or coatings that are insoluble.

Unprinted Bleached Board: Consists of groundwood-free unprinted, untreated bleached board cuttings, sheets or rolls, free from wax, greaseproof lamination and adhesives or coatings that are insoluble.

In an embodiment of this invention, the preferred recovered post-consumer paper is of the kraft-type or which contains or is manufactured based on kraft paper, such as, Corrugated Containers (OCC), kraft paper, Mill Wrappers, New Double-Lined Kraft Corrugated Cuttings, Used Brown Kraft, Mixed Kraft Cuttings, New Colored Kraft, Grocery Bag Scrap (KGB), Kraft Multi-Wall Bag Scrap, New Brown Kraft Envelope Cuttings, and combinations thereof. The range of content of recovered post-consumer paper of the composition of the paper from this invention is from 10% to 40% by weight.

The term "recovered white paper" in the context of current description refers to white paper obtained from the waste generated in the process of preparing said paper, or paper or paper objects that have not been used by the end-user and later have been returned to the factory for recycling. Some examples of recovered white paper that can be used in this invention are:

White Blank News (WBN): Consists of unprinted cuttings and sheets of white newsprint or other uncoated white groundwood paper of similar quality.

Publication Blanks (CPB): Consists of unprinted cuttings or sheets of white coated or filled groundwood content paper.

Coated Soft White Shavings (SWS): Consists of unprinted, coated, and uncoated shavings and sheets of white groundwood-free printing paper or with little content of groundwood.

Hard White Shavings (HWS): Consists of shavings or sheets of unprinted, untreated white groundwood-free pape.

Hard White Envelope Cuttings (HWEC): Consists of groundwood-free cuttings, shavings, or sheets of unprinted, untreated, and uncoated white envelope paper.

Sorted White Ledger (SWL): Consists of uncoated, printed or unprinted sheets, shavings, guillotined books, and cuttings of white groundwood-free ledger, bond, writing, and other paper which has similar fiber and filler content.

Manifold White Ledger (MWL): Consists of sheets, shavings, and cuttings of industrially generated printed or unprinted white groundwood-free paper. All stock must be uncoated and free of nonimpact printing.

Computer Printout (CPO): Consists of white groundwood-free paper in forms manufactured for use in data processing machines. This grade may contain colored stripes and impact or non-impact (e.g. laser) computer printing, and may contain no more than 5% groundwood in the pack. All stock must be untreated and uncoated.

Coated Book Stock (CBS): Consists of coated groundwood-free paper, printed or unprinted in sheets, shavings, guillotined books and cuttings. A reasonable percentage of paper containing fine groundwood may be included.

In the embodiment of this invention, the recovered white paper content is within a range from 60% to 90% by weight, of which at least 20% by weight of white waste paper and 40% to 70% by weight of pre-consumer white paper.

Sizing Agents

In order to obtain a superficial smooth finishing of the paper of the current invention one or more sizing agents are incorporated, which are selected from alkyl ketene dimer and derivatives, alkenyl succinic anhydride, calcium stearate, cellulose stearate, and combinations thereof.

In accordance with the stages of a paper making process of the prior art, an internal sizing of the paper of the invention can be performed during or after the stage of refining the paper pulp, by applying alkyl ketene dimer and derivatives, and alkenyl succinic anhydride, and a superficial sizing can be performed during a sizing stage by pressing, applying an alkyl ketene dimer and derivatives, alkenyl succinic anhydride, calcium stearate, cellulose stearate, and combinations thereof. For an effective sizing, it is convenient that the sizing agent is distributed evenly across the fibers of the paper pulp, which is recommended to prepare emulsions or dispersions containing an aqueous phase and finely divided particles of sizing agents dispersed in the same, and with the use of emulsion stabilizers. The emulsion stabilizers or binding agents commonly used to prepare such emulsions are, for example, starches and cationic polymers that are described below.

In an embodiment of the invention, one or more sizing agents are used in 0.38% to 0.45% by weight, and particularly alkyl ketene dimer and derivatives are used.

Fillers

In order to increase the opacity and improve the printing quality of the paper of the present invention and serve as a sealant for said paper, microparticles of fillers are incorporated, which are selected of calcium carbonate, granulated calcium carbonate, precipitated calcium carbonate, kaolin, titanium dioxide, rutile titanium dioxide, anatasic titanium dioxide, hydrated aluminum silicate, talc, and combinations thereof.

The calcium carbonate, granulated calcium carbonate and/or precipitated calcium carbonate are basically used to increase the resistance the opacity and improve the printing quality of the paper of this invention; whereas together with the incorporation in the rutilic titanium dioxide and/or anatasic titanium dioxide, the opacity property is improved, as well as the whiteness of the paper of this invention.

In a paper producing process according to prior art, the fillers can be added during the preparation and refining of the paper pulp, as well as once the paper is manufactured during the pasting stage by pressing.

In an embodiment of the invention, 4.4% to 19% by weight of one or more fillers is used, and particularly calcium carbonate.

Binding Agents

In order to increase the resistance of the paper of the invention and serve as a sealant for said paper, one or more binding agents are incorporated, such as starch, cationic starch, cationic amylopectin starch, acetylated starch, ethylated starch, polyvinyl alcohol, carboxy-methyl cellulose, anionic polyacrylamide, cationic polyacrylamide, epichlorohydrin polyamine, polyvinyl acetate, polyacrylates, polyacrylic acid, polystyrene, amylopectin-2-hydroxy-3-(trimethylammonium)propyl ether chloride, and combinations thereof.

According to the invention, the use of cationic starch is preferred, in particular cationic amylopectine starch can be prepared from treating amylopectin starch with a cationic agent such as 3-chloro-2-hydroxypropyl(trimethylammonium)chloride, 2,3-epoxypropyl(trimethylammonium)chloride, or 2-chloro ethyl(trimethylammonium)chloride, obtaining, for example, amylopectin-2-hydroxy-3-(trimethylammonium)propyl ether chloride.

The cationic amylopectin starch can be added at any point in the production process of the paper, for example, during or after the refining stage of the paper pulp. If wanted, in addition to the cationic amylopectin starch, cationic starch can also be added to the paper pulp.

The cationic starch can be made through chemical modification of the starch, or just by boiling the raw starch and adding a cationic polymer of low molecular weight before, during or after the boiling, for example, cationic polyacrylamide.

The starch, cationic starch, cationic amylopectine starch, acetylated starch, ethylated starch, and chloride of 2-hydroxi-3-(trimetilamonium)amylopectin propyl ether are used as reinforcement supports.

On the one hand, epichlorohydrin polyamine resins, anionic polyacrylamide resins, and mixtures thereof act as binding agents to determine and uniformly deposit the fillers in the cellulose fiber, whereas the acetylated starch, ethylated starch, cellulose carboxymethyl resins, cationic polyacrylamide resins, polyvinyl alcohol resins, starch, cationic starch, cationic amylopectin starch, amylopectin-2-hydroxy-3-(trimethylammonium)propyl ether chloride, and mixtures thereof act as binding agents for resistance to the traction of the paper in the dry state, and in particular the amylopectin-2-hydroxy-3-(trimethylammonium)propyl ether chloride improves the resistance to tearing. Whereas on the other side, the sodium polyacrylate acts as a disperser.

In an embodiment of the invention, one or more binding agents from 3.33% to 3.95% by weight are used, and particularly from 2.2% to 2.6% by weight of acetylated starch, from 0.38% to 0.45% by weight of epicholorohydrin polyamine, and from 0.75% to 0.9% by weight of cationic starch.

Other Compounds

In order to contribute to the process for manufacturing the paper of this invention, and provide an improved appearance and qualities of printing paper, 0.04% to 0.05% by weight of processing aids selected among fatty acid esters and surfactants can be incorporated into the composition; from 0.6% to 0.75% by weight of agents for printing, for example, the use of salts as described in U.S. patent documents U.S. Pat. No. 6,207,258, US-20050217815, US-20070087136 and 20070087138, owned by Hewlett-Packard® to obtain a high quality printing paper, and from 0.75% to 0.9% by weight of synthetic fibers, for example, aventurine red, green or other colored aventurines, and combinations thereof.

Composition of the Paper of this Invention

The paper produced according to this invention presents a composition from 10% to 40% by weight of recovered post-consumer paper; from 60% to 90% by weight of recovered white paper; from 0.38% to 0.45% by weight of one or more sizing agents, from 4.4% to 19% by weight of one or more fillers, and from 3.33% to 3.95% by weight of one or more binding agents.

Where the total of the recovered post-consumer paper is of recovered post-consumer paper kraft type; from the recovered white paper at least 20% by weight is white waste paper and 40% to 70% by weight is white pre-consumer paper; as to the sizing agents, the total is alkyl ketene dimer and derivatives, as to the contents of the fillers, the total is of calcium carbonate, and as to the binding agents, 2.2% to 2.6% by weight is acetylated starch, 0.38% to 0.45% by weight is epichlorohydrin polyamine, and 0.75% to 0.9% by weight is cationic starch.

Process for Producing the Paper of the Invention

The paper of this invention is produced from a pulp mixture of 10% to 40% by weight of recovered post-consumer paper, of 60% to 90% by weight of recovered white paper (which, at least 20% by weight is white waste paper and 40% to 70% by weight is of pre-consumer white paper), and 0.38% to 0.45% by weight of one or more binding agents, particularly epicholorohydrin polyamine. Alternatively, at this stage, 4.4% to 19% by weight of calcium carbonate can be added as a filler.

Then, during or after a stage of refining, the pulp mixture is reacted with 0.38% to 0.45% by weight of one or more sizing agents, preferably alkyl ketene dimer; and with 0.75% to 0.9% by weight of one or more binding agents, preferably cationic starch. Alternatively, at this stage, processing aids can added from 0.04% to 0.05% by weight of such as fatty acid esters and surfactants.

Subsequently, a continuous sheet of paper is formed and dried, which is reacted with 2.2% to 2.6% by weight of one or more binding agents, preferably acetylated starch. Alternatively, at this stage, can be add 0.6% to 0.75% by weight of one or more printing agents; and 0.75% to 0.9% by weight of synthetic fibers of one or more synthetic fibers, in particular, red aventurine, green aventurine or other colors, and combinations thereof.

Mechanical and Physical Properties of the Paper of the Invention

The paper manufactured according to this invention has the following physical-mechanical properties, shown in Table 1 according to the standards and methods of the Technical Association of Pulp and Paper Industry known by its initials in English as TAPPI.

TABLE 1

| Property | Unit | Paper of this invention with a printing agent | Paper of this invention without a printing agent | Method |
|---|---|---|---|---|
| Base Weight | $g/m^2$ | 73 | 72 | T - 410 |
| Thickness | in. × $10^{-3}$ | 4.3 | 4.2 | T - 411 |
| Smoothness LF | Sheffield | 279 | 278 | |
| Smoothness LT | Sheffield | 256 | 266 | |
| Porosity | Gurley | 29 | 22 | T - 460 |
| Absolute Humidity | % | 6.8 | 7 | T - 412 |
| DM Tension | kg/15 mm | 7.14 | 7.98 | T - 404 |
| DT Tension | | 3.43 | 2.88 | T - 404 |
| DM Tearing | grams | 56 | 55 | T - 414 |
| DT Tearing | | 62 | 65 | T - 414 |
| Stiffness DM | g-cm | 2.4 | 3.2 | T - 489 |
| Stiffness DT | | 1.6 | 1.3 | T - 489 |
| Mullen | $lb/inch^2$ | 22 | 24 | T - 403 |
| Hercules Sizing | sec | 197 | 223 | T - 530 |
| Dennison | Nr. Wax | 18/16 | 18/16 | T - 459 |
| Whiteness | % | | | T - 452 |
| Opacity | % | 97.8 | 95.7 | T - 425 |
| Hunter Color | L | 77.2 | 75.8 | T - 524 |
| Hunter Color | a | 2.1 | 1.9 | T - 524 |
| Hunter Color | b | 8.4 | 11.1 | T - 524 |
| Ashes | % | 7.1 | 6.1 | T - 413 |

EXAMPLES OF EMBODIMENTS OF THE INVENTION

The invention will now be described in reference to the following examples, which is solely for the purpose of presenting the way of carrying out the implementation of the principles of the invention. The following examples are not intended to be a comprehensive presentation of the invention, nor try to limit the scope thereof.

Example 1

A pulp mixture is prepared containing 200 kg of recovered post-consumer paper, 800 kg of recovered pre-consumer white paper, 150 kg of calcium carbonate, and 0.5 kg of epichlorohydrin polyamine resin per ton of produced paper. Later during or after the refining stage, this pulp mixture is completed with 10 kg of cationic starch, 5 kg of alkyl ketene dimer, and 0.54 kg of fatty acid esters and surfactants for each ton of paper produced. Once the continuous sheet of paper is formed, it is reacted by a gluing press with 29 kg of acetylated starch, 8.4 kg of a printing agent, and 10 kg red aventurines are added per ton of paper produced. FIG. 1 shows the frame of the paper of this invention 200× increased according to example 1.

Example 2

The same preparation of Example 1, except that during the preparation of the pulp mixture 50 kg of calcium carbonate is used per ton of paper produced.

Example 3

The same preparation of Example 1, except that during the preparation of the pulp mixture 250 kg of calcium carbonate is used per ton of paper produced.

Example 4

Figure 2:
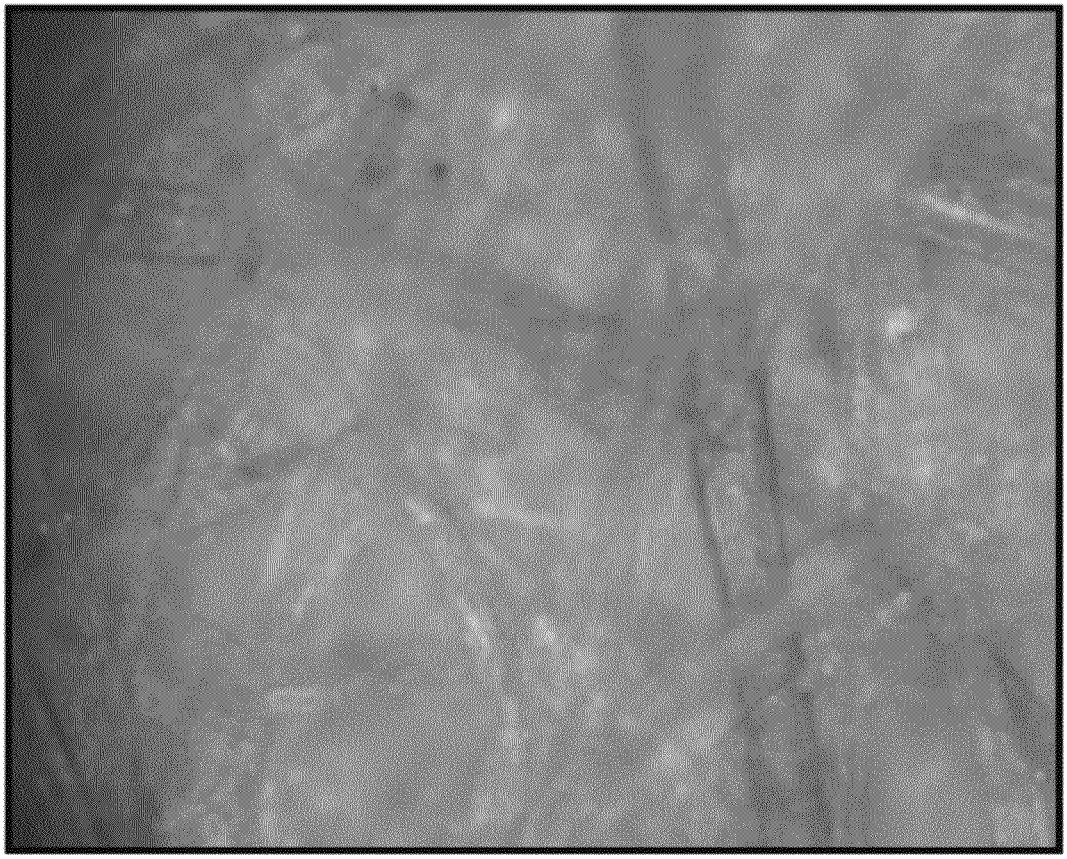
FIG. 2 illustrates a magnified view 200× of a portion of a frame of a second embodiment of a paper according to this invention.

A pulp mixture is prepared containing 100 kg of recovered post-consumer paper, 900 kg of recovered pre-consumer white paper, 150 kg of calcium carbonate, and 0.5 kg of epichlorohydrin polyamine resin per ton of produced paper. Later during or after the refining stage, this pulp mixture is completed with 10 kg of cationic starch, 5 kg of alkyl ketene dimer, and 0.54 kg of fatty acid esters and surfactants for each ton of paper produced. Once the continuous sheet of paper is formed, it is reacted by a gluing press with 29 kg of acetylated starch, 8.4 kg of a printing agent, and 10 kg green aventurines are added per ton of paper produced. FIG. 2 shows the frame of the paper of this invention 200× increased according to example 4.

Example 5

The same preparation of Example 5, except that during the preparation of the pulp mixture 50 kg of calcium carbonate is used per ton of paper produced.

Example 6

The same preparation of Example 5, except that during the preparation of the pulp mixture 250 kg of calcium carbonate is used per ton of paper produced.

Example 7

Figure 3:
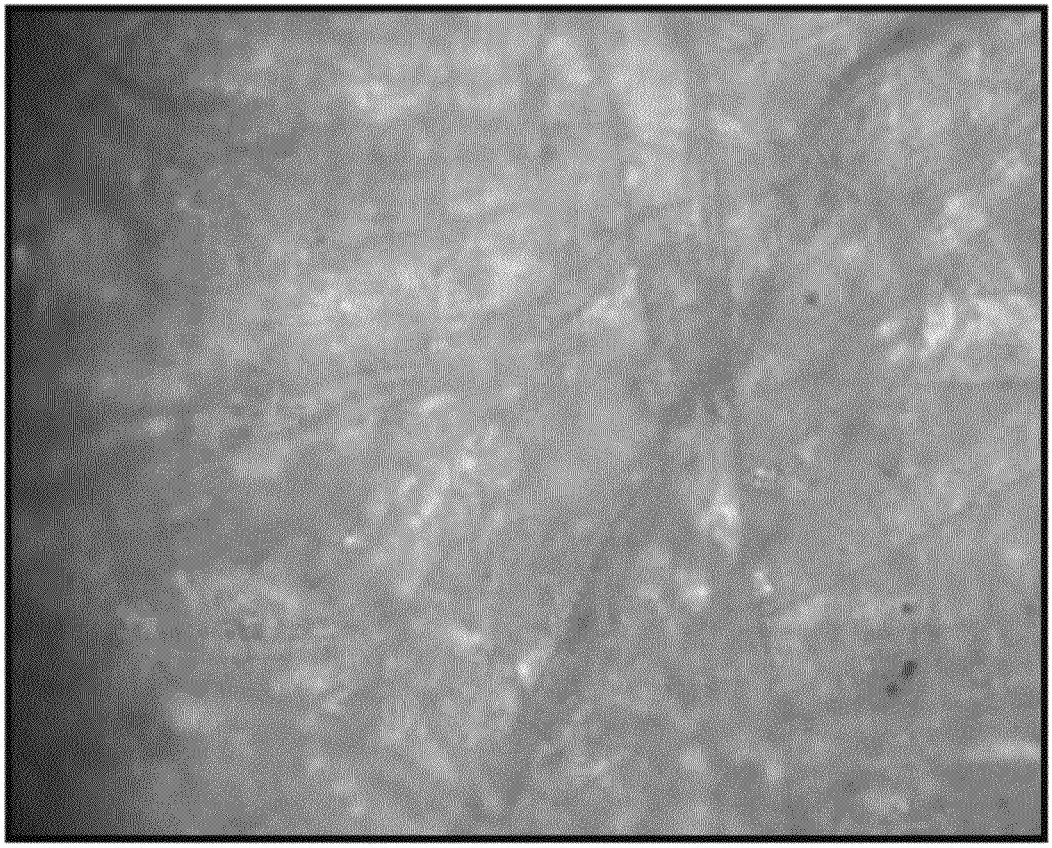
FIG. 3 illustrates a magnified view 200× of a portion of a frame of a third embodiment of a paper according to this invention.

A pulp mixture is prepared containing 300 kg of recovered post-consumer paper, 700 kg of recovered pre-consumer white paper, 150 kg of calcium carbonate, and 0.5 kg of epichlorohydrin polyamine resin per ton of produced paper. Later during or after the refining stage, this pulp mixture is completed with 10 kg of cationic starch, 5 kg of alkyl ketene dimer, and 0.54 kg of fatty acid esters and surfactants for each ton of paper produced. Once the continuous sheet of paper is formed, it is reacted by a gluing press with 29 kg of acetylated starch, 8.4 kg of a printing agent, and 10 kg red aventurines are added per ton of paper produced. FIG. 3 shows the frame of the paper of this invention 200× increased according to example 7.

Example 8

The same preparation of Example 7, except that during the preparation of the pulp mixture 50 kg of calcium carbonate is used per ton of paper produced.

Example 9

The same preparation of Example 7, except that during the preparation of the pulp mixture 250 kg of calcium carbonate is used per ton of paper produced.

Example 10

Figure 4:
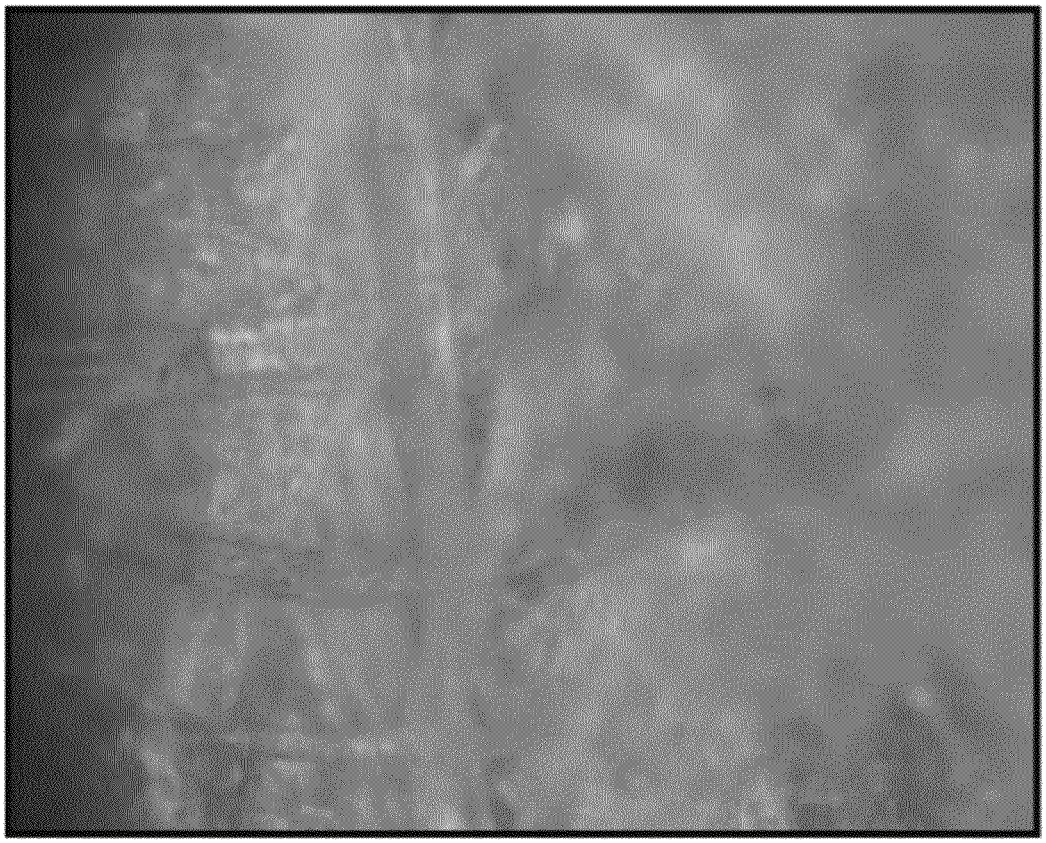
FIG. 4 illustrates a magnified view 200× of a portion of a frame of a fourth embodiment of a paper according to this invention.

A pulp mixture is prepared containing 400 kg of recovered post-consumer paper, 600 kg of recovered pre-consumer white paper, 150 kg of calcium carbonate, and 0.5 kg of epichlorohydrin polyamine resin per ton of produced paper. Later during or after the refining stage, this pulp mixture is completed with 10 kg of cationic starch, 5 kg of alkyl ketene dimer, and 0.54 kg of fatty acid esters and surfactants for each ton of paper produced. Once the continuous sheet of paper is formed, it is reacted by a gluing press with 29 kg of acetylated starch, 8.4 kg of a printing agent, and 10 kg green aventurines are added per ton of paper produced. FIG. 4 shows the frame of the paper of this invention 200× increased according to example 10.

Example 11

The same preparation of Example 10, except that during the preparation of the pulp mixture 50 kg of calcium carbonate is used per ton of paper produced.

Example 12

The same preparation of Example 10, except that during the preparation of the pulp mixture 250 kg of calcium carbonate is used per ton of paper produced.

Each of the examples 1 to 12 were tested for base weight, opacity and L, a and b tone. The results are shown in Table 2.

TABLE 2

| Test | EXAMPLE 1 | EXAMPLE 2 | EXAMPLE 3 | EXAMPLE 4 | EXAMPLE 5 |
|---|---|---|---|---|---|
| Base Weight $g/m^2$ (T - 410) | 94 | 93 | 103 | 80 | 75 |
| Opacity | 100 | 97 | 100 | 92 | 91 |
| Hunter Color "L" (T - 524) | 75.79 | 75.00 | 75.08 | 80.34 | 81.27 |
| Hunter Color "a" (T - 524) | 1.93 | 1.93 | 2.06 | 1.21 | 1.06 |
| Hunter Color "b" (T - 524) | 9.79 | 9.66 | 9.97 | 8.14 | 7.17 |

| Test | EXAMPLE 6 | EXAMPLE 7 | EXAMPLE 8 | EXAMPLE 9 | EXAMPLE 10 |
|---|---|---|---|---|---|
| Base Weight $g/m^2$ (T - 410) | 61 | 112 | 105 | 132 | 140 |
| Opacity | 89 | 99 | 98 | 100 | 100 |
| Hunter Color "L" (T - 524) | 80.09 | 71.28 | 71.35 | 72.64 | 68.45 |
| Hunter Color | 1.24 | 3.39 | 3.38 | 3.30 | 2.50 |

TABLE 2-continued

| | | | | | |
|---|---|---|---|---|---|
| "a" (T - 524) | | | | | |
| Hunter Color "b" (T - 524) | 8.58 | 9.92 | 10.09 | 9.59 | 11.58 |

| Test | EXAMPLE 11 | EXAMPLE 12 |
|---|---|---|
| Base Weight $g/m^2$ (T- 410) | 131 | 130 |
| Opacity | 100 | 99 |
| Hunter Color "L" (T - 524) | 67.90 | 68.74 |
| Hunter Color "a" (T - 524) | 2.64 | 2.43 |
| Hunter Color "b" (T - 524) | 12.10 | 11.76 |

According to these examples and other embodiments, the paper of this invention has some properties such as a base weight of 50 g/m2 to 220 g/m2, an opacity of 95% to 100%, a Hunter Color "L" from 65 to 82, a Hunter Color "a" from 1 to 4 and a Hunter Color "b" from 7 to 12.3.

The paper of this invention can be applied, for example, xerographic printing, ink jet or laser printing, advertising print, in the preparation of envelopes, notebooks, books and generally any type of paper for office use.

Finally, it must be understood that the paper based on recovered paper and with the characteristic of high quality printing paper, and the process for producing this paper according to the invention are not limited to the modality or modalities described above and that experts in the field will be trained, by the teachings herein, to carry out changes in the composition of the paper and the process conditions of the present invention, which scope will be established exclusively by the following claims:

The invention claimed is:

1. A paper characterized by comprising:

from 10% to 40% by weight of recovered post-consumer paper;

from 60% to 90% by weight of recovered white paper;

from 0.38% to 0.45% by weight of one or more sizing agents; and from 3.33% to 3.95% by weight of one or more binding agents.

2. The paper of claim 1, characterized in that the recovered post-consumer paper is selected from a group consisting of Cardboard, Solid Fibreboard, Corrugated Containers (OCC), Simple Corrugated Cardboard, Single-sided Corrugated Cardboard, Double Corrugated Cardboard, Rolled Cardboard, Duplex, Triplex or Multiplex Cardboard, Gray Cardboard, Solid Cardboard, Paper board, Kraft paper, Soft Mixed Paper (SMP), Hard Mixed Paper (HMP), Boxboard Cuttings, Mill Wrappers, Groundwood paper, News, News De-ink Quality (#70NP), Special News De-ink Quality (#80NP), Over-Issue News (OI or OIN), Magazines (OMG), New Double-Lined Kraft Corrugated Cuttings (DLK), Used Brown Kraft, Mixed Kraft Cuttings, New Colored Kraft, Grocery Bag Scrap (KGB), Kraft Multi-Wall Bag Scrap, New Brown Kraft Envelope Cuttings, Mixed Groundwood Shavings, Groundwood Computer Printout (GWCPO), New Colored Envelope Cuttings, Semi Bleached Cuttings, Unsorted Office Paper (UOP), Sorted Office Paper (SOP), Manifold Colored Ledger (MCL), Coated Groundwood Sections (CGS), Printed Bleached Board Cuttings, Misprinted Bleached Board, Unprinted Bleached Board, and combinations thereof.

3. The paper of claim 2, characterized in that the recovered post-consumer paper is kraft-type selected from a group consisting of Corrugated Containers (OCC), Kraft Paper, Mill Wrappers, New Double-Lined Kraft Corrugated Cuttings (DLK), Used Brown Kraft, Mixed Kraft Cuttings, New Colored Kraft, Grocery Bag Scrap (KGB), Kraft Multi-Wall Bag Scrap, New Brown Kraft Envelope Cuttings, and combinations thereof.

4. The paper of claim 1, characterized in that the recovered white paper is selected from a group consisting of White Blank News (WBN), Publication Blanks (CPB), Coated Soft White Shavings (SWS), Hard White Shavings (HWS), Hard White Envelope Cuttings (HWEC), Sorted White Ledger (SWL), Manifold White Ledger (MWL), Computer Printout (CPO), Coated Book Stock (CBS), and combinations thereof.

5. The paper of claim 1, characterized in that the recovered white paper comprising:

at least 20% by weight of white waste paper; and from 40% to 70% by weight of pre-consumer white paper.

6. The paper of claim 1, characterized in that the properties are:

a base weight from 50 g/m2 to 220 g/m2;

an opacity of 95% to 100%;

a hunter color "L" from 65 to 82;

a hunter color "a" from 1 to 4; and a hunter color "b" from 7 to 12.3.

7. The paper of claim 1, characterized in that the sizing agent is selected from a group consisting of alkyl ketene dimer and its derivatives, alkenyl succinic anhydride, calcium stearate, cellulose stearate, and combinations thereof.

8. The paper of claim 7, characterized in that the sizing agent is alkyl ketene dimer and its derivatives.

9. The paper of claim 1, characterized in that further including one or more fillers selected from a group consisting of calcium carbonate, granulated calcium carbonate, precipitated calcium carbonate, kaolin, titanium dioxide, rutile titanium dioxide, anatasic titanium dioxide, hydrated aluminum silicate, talc, and combinations thereof.

10. The paper of claim 9, characterized in that including from 4.4% to 19% by weight of calcium carbonate.

11. The paper of claim 1, characterized in that the binding agent is selected from a group consisting of starch, cationic starch, cationic amylopectin starch, acetylated starch, ethylated starch, polyvinyl alcohol, carboxy-methyl cellulose, anionic polyacrylamide, cationic polyacrylamide, epichlorohydrin polyamine, polyvinyl acetate, polyacrylates, polyacrylic acid, polystyrene, amylopectin-2-hydroxy-3-(trimethylammonium) propyl ether chloride, and combinations thereof.

12. The paper of claim 11, characterized in that including:

from 2.2% to 2.6% by weight of acetylated starch;

from 0.38% to 0.45% by weight of polyamine epichlorohydrin; and from 0.75% to 0.9% by weight of cationic starch.

13. The paper of claim 1, characterized in that further including from 0.04% to 0.05% by weight of processing aids selected from fatty acid esters and surfactants.

14. The paper of claim 1, characterized in that further including from 0.6% to 0.75% by weight of one or more printing agents.

15. The paper of claim 1, characterized in that further including from 0.75% to 0.9% by weight of synthetic fibers selected from a group consisting of red aventurines, green aventurines or other colors, and combinations thereof.

US 8,349,133 B2
13 14

* * * * *